US011040759B2

(12) United States Patent
Coletti et al.

(10) Patent No.: US 11,040,759 B2
(45) Date of Patent: Jun. 22, 2021

(54) BOAT WINDSHIELD WITH INTEGRATED AUDIO SYSTEM

(71) Applicant: Taylor Made Group, LLC, Gloversville, NY (US)

(72) Inventors: Garrett Michael Coletti, Asbury, NJ (US); Philip A. Oakes, Middle Grove, NY (US)

(73) Assignee: Taylor Made Group, LLC, Gloversville, NY (US)

( * ) Notice: Subject to any disclaimer, the term of this patent is extended or adjusted under 35 U.S.C. 154(b) by 324 days.

(21) Appl. No.: 16/143,746

(22) Filed: Sep. 27, 2018

(65) Prior Publication Data

US 2019/0092437 A1 Mar. 28, 2019

Related U.S. Application Data

(60) Provisional application No. 62/563,882, filed on Sep. 27, 2017.

(51) Int. Cl.

| | |
|---|---|
| ***H04R 1/02*** | (2006.01) |
| ***B63B 45/08*** | (2006.01) |
| ***B63B 19/02*** | (2006.01) |
| ***H04R 1/26*** | (2006.01) |
| ***H04R 1/34*** | (2006.01) |
| ***H04R 5/02*** | (2006.01) |

(52) U.S. Cl.

CPC ..... *B63B 45/08* (2013.01); *B63B 19/02* (2013.01); *H04R 1/02* (2013.01); *H04R 1/025* (2013.01); *H04R 1/26* (2013.01); *H04R 1/345* (2013.01); *H04R 5/02* (2013.01); *H04R 2499/13* (2013.01)

(58) Field of Classification Search

CPC . H04R 1/02; H04R 1/025; H04R 1/26; H04R 1/345; H04R 5/02; H04R 2499/13; B63B 19/02; B63B 45/08

USPC ..... 381/302, 86, 87, 332, 386, 389

See application file for complete search history.

(56) References Cited

U.S. PATENT DOCUMENTS

| | | | | |
|---|---|---|---|---|
| 5,148,490 | A | 9/1992 | Draffen | |
| 5,749,119 | A | 5/1998 | Isaac | |
| 5,779,205 | A | 7/1998 | Ching | |
| 5,966,453 | A * | 10/1999 | Koyano | H04R 5/02 381/389 |
| 6,154,124 | A | 11/2000 | Jackman et al. | |
| 7,742,615 | B1 | 6/2010 | Lopez | |
| 7,796,056 | B2 | 9/2010 | Fein et al. | |
| 8,488,818 | B2 * | 7/2013 | Biggs | H04R 1/021 381/302 |
| 9,365,161 | B2 | 6/2016 | Mannheim Astete et al. | |
| 10,040,425 | B2 | 8/2018 | Green et al. | |
| 2004/0047476 | A1 * | 3/2004 | Sato | H04R 5/02 381/89 |
| 2017/0169810 | A1 * | 6/2017 | Nesbit, Jr. | H04R 1/345 |

* cited by examiner

*Primary Examiner* — Huyen D Le
(74) *Attorney, Agent, or Firm* — Nixon & Vanderhye P.C.

(57) ABSTRACT

A windshield includes a framework with a bottom trim and a top trim, a windshield panel secured to the framework, and a speaker system secured to the framework adjacent the windshield panel between the bottom trim and the top trim. The windshield integrates speakers just above the deck and closer to passenger head level. The design provides a much more balanced listening experience in a visually pleasing package.

15 Claims, 4 Drawing Sheets

BOAT WINDSHIELD WITH INTEGRATED AUDIO SYSTEM

CROSS-REFERENCES TO RELATED APPLICATIONS

This application claims the benefit of U.S. Provisional Patent Application No. 62/563,882, filed Sep. 27, 2017, the entire content of which is herein incorporated by reference.

STATEMENT REGARDING FEDERALLY SPONSORED RESEARCH OR DEVELOPMENT (NOT APPLICABLE)

BACKGROUND

The invention relates to marine windshields and, more specifically, to a marine windshield including an integrated audio system.

In existing boats that include audio systems, speakers are typically installed below deck, in the cockpit area or above the windshield in an archway or tower. These locations, however, are not ideal for optimal listening as the sound is not appropriately directed toward the occupants of the boat.

BRIEF SUMMARY

The described embodiments endeavor to better position audio components in a boat by integrating the speakers into a windshield just above the deck and closer to passenger head level. The design provides a much more balanced listening experience in a visually pleasing package.

In an exemplary embodiment, a windshield includes a framework including a bottom trim and a top trim, a windshield panel secured to the framework, and a speaker system secured to the framework adjacent the windshield panel between the bottom trim and the top trim. The framework may include a forward section and two side sections extending aft from the forward section. In this context, the framework may define a passenger area, where the speaker system may be positioned in the framework adjacent a head level in the passenger area.

The speaker system may include a first component secured adjacent an aft end of each of the side sections. The speaker system may include a second component secured adjacent a forward end of each of the side sections. In some embodiments, the first component may include a woofer and a tweeter.

The speaker system may be positioned facing the passenger area. The windshield may also include a lighting system coupled with the speaker system that faces away from the passenger area. The lighting system may be reactive to audio output.

The framework may further include a vertical trim connecting each of the two side sections with the forward section, where at least part of the speaker system may be bounded by the bottom trim, the windshield panel and the vertical trim.

Generally, at least part of the speaker system may be positioned through the windshield panel.

BRIEF DESCRIPTION OF THE DRAWINGS

These and other aspects and advantages will be described in detail with reference to the accompanying drawings, in which.

DETAILED DESCRIPTION

Figure 1:
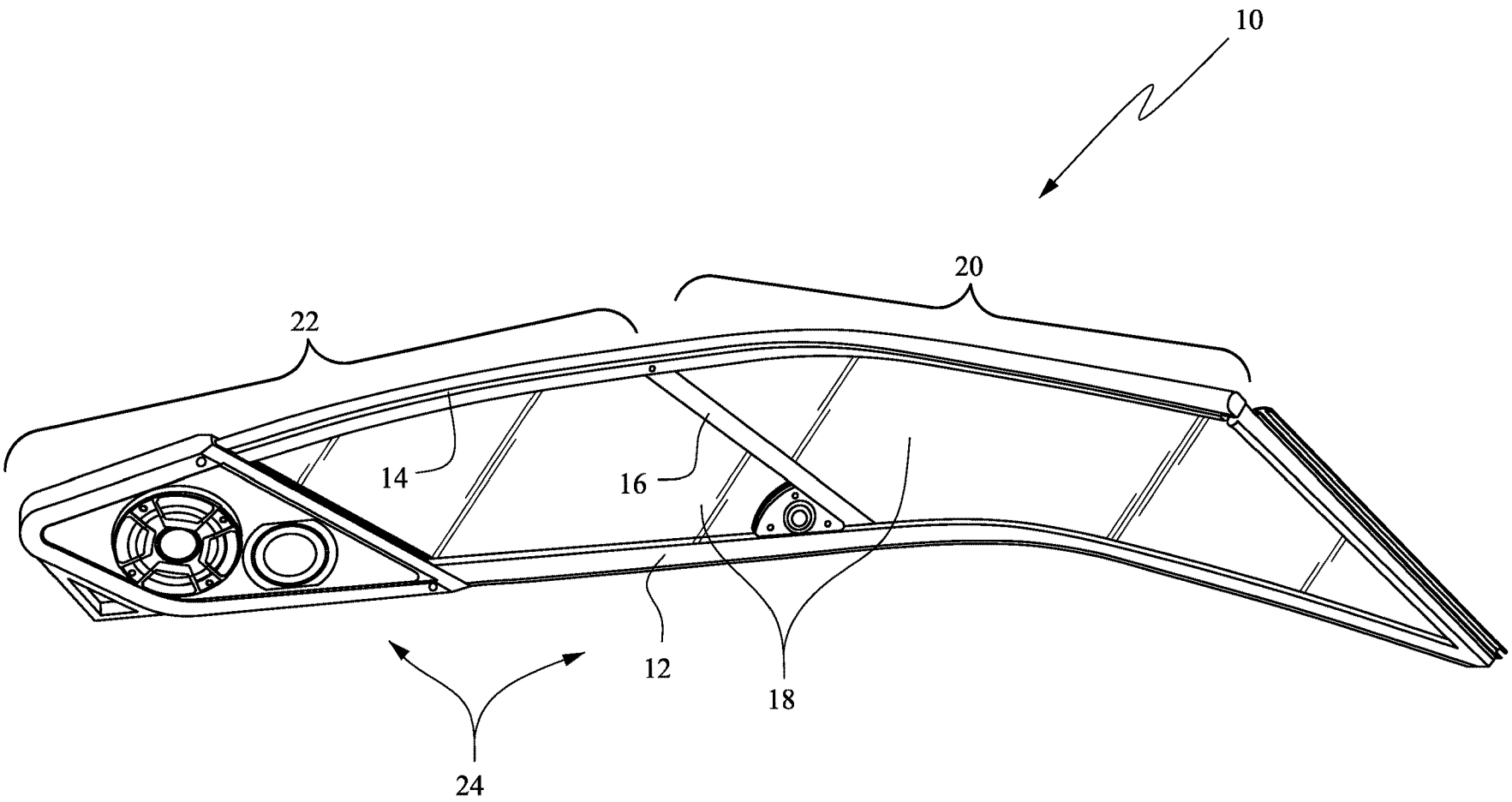
FIG. 1 is an inside perspective view of an exemplary windshield according to the described embodiments.

FIG. 1 is an inside perspective view of an exemplary windshield according to the described embodiments. FIG. 1 shows an exemplary left-side portion of a windshield assembly, where a right side of the windshield is a mirror image. A pivotable door or the like (not shown) may be positioned between the left side and the right side of the windshield assembly.

The windshield 10 includes a framework with a bottom trim 12, a top trim 14, and in some embodiments, a vertical trim 16. One or more windshield panels 18 are secured in the framework. That is, the assembly may include a single panel or multiple panels coupled together. The windshield panels 18 are preferably formed of glass or laminated glass or another suitable transparent or partially-transparent material.

In the embodiment shown in FIG. 1, the framework includes a forward section 20 and a side section 22, separated by the vertical trim 16. A complete windshield assembly will also include at least a second side section 22 on a right-side portion of the windshield assembly. The entire assembly may include a single forward section 20 or separated forward sections 20 as noted. The framework is curved as shown and defines or delimits a passenger area.

A speaker system 24 is secured to the framework adjacent the windshield panel 18 between the bottom trim 12 and the top trim 14. As shown, the speaker system 24 is positioned in the framework adjacent a head level in the passenger area, and in a preferred construction, the speaker system 24 is positioned facing the passenger area. The speaker system 24 may be configured to face away from the passenger area or may include components for directing audio output in both inward and outward directions.

Figure 2:
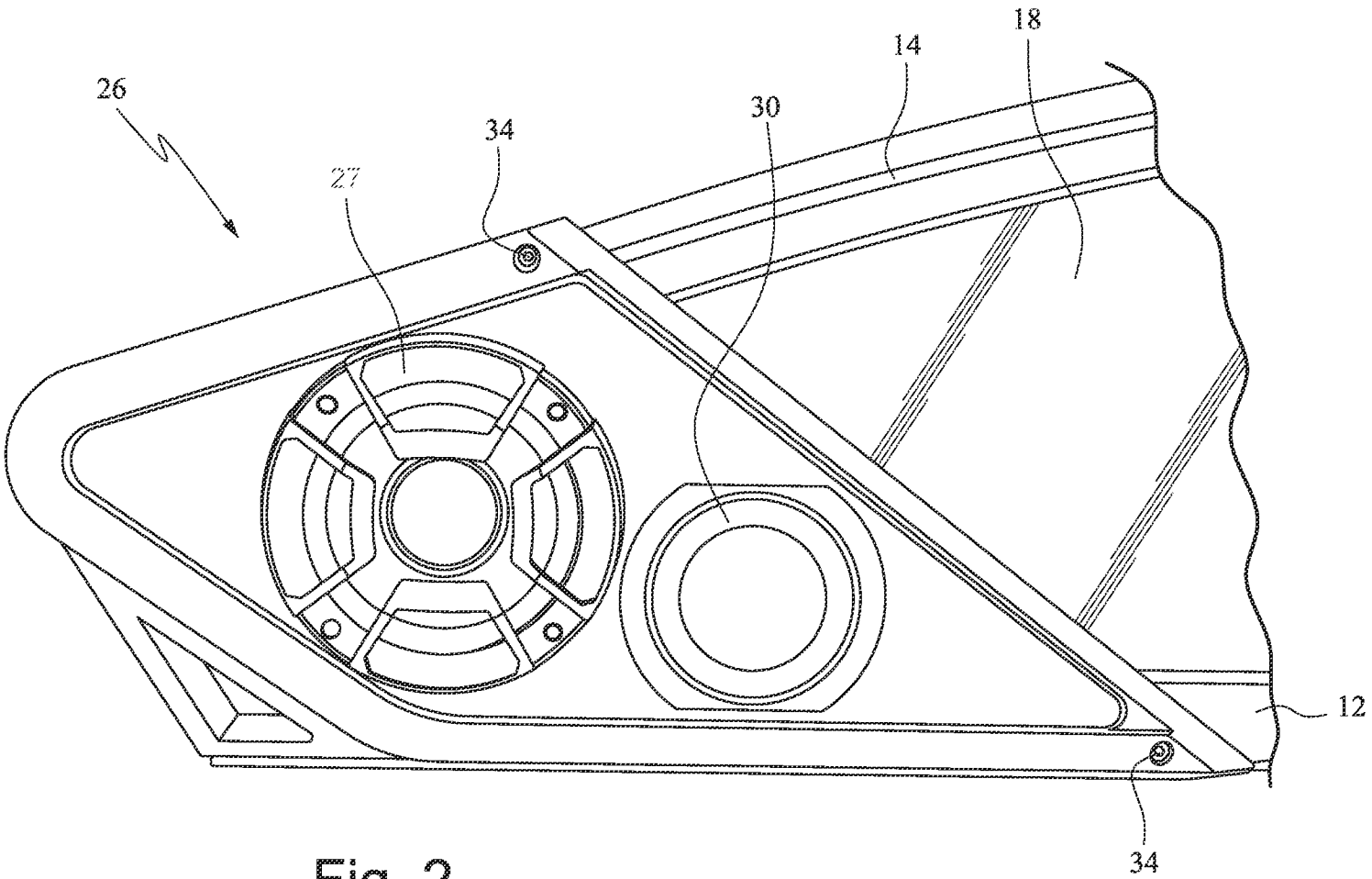
FIG. 2 is a close-up view of a first speaker system component secured adjacent an aft end of the windshield.
Figure 3:
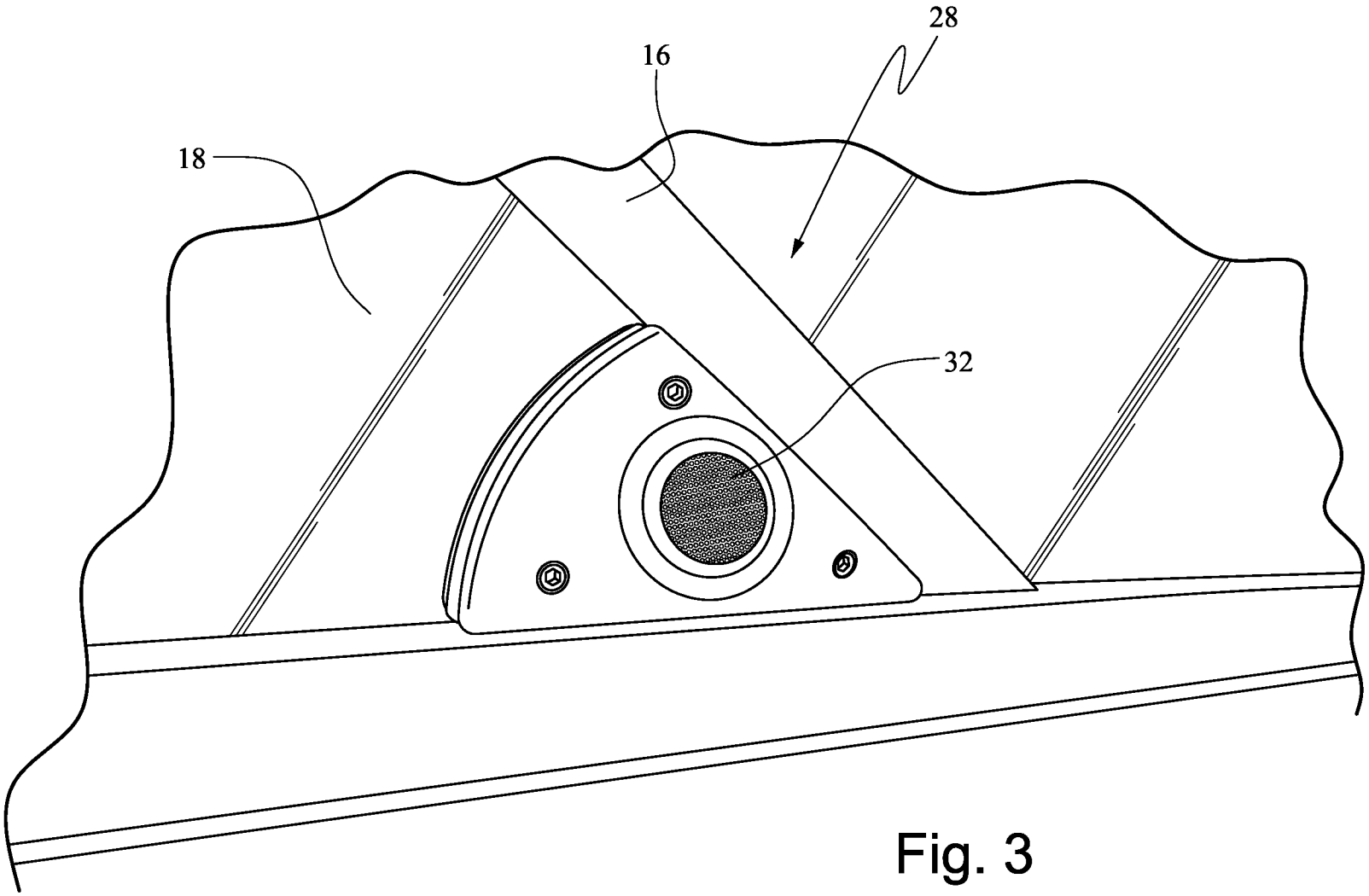
FIG. 3 is a close-up view of a speaker system component adjacent a forward end of a windshield side section.

With reference to FIGS. 1-3, in an exemplary construction, the speaker system 24 may be provided with multiple components secured to the windshield assembly at various positions to provide a balanced listening experience for the boat passengers. FIG. 2 shows an exemplary speaker component 26 secured adjacent an aft end of the side section 22. A similar component 26 is secured in the aft end of the opposite-side side section. The component 26 may include conventional speaker drivers such as a woofer 27 and a tweeter 30. A second component 28 of the speaker system may be secured adjacent a forward end of each of the side sections 22. In an exemplary construction, the second component 28 may include a mid-range driver 32 or the like. The speaker system 24 may include more or fewer speaker components.

Either of the speaker components 26, 28 may be secured directly to the windshield panel 18 or may alternatively be positioned through the windshield panel 18. For example, in FIG. 3, the second component 28 may be secured in an opening in the panel 18. In this manner, the component is bounded by the bottom trim 12, the windshield panel 18 and the vertical trim 16. FIG. 2 shows the first component 26 secured directly to the trim 12, 14 adjacent the windshield panel 18 by suitable connectors 34.

Figure 4:
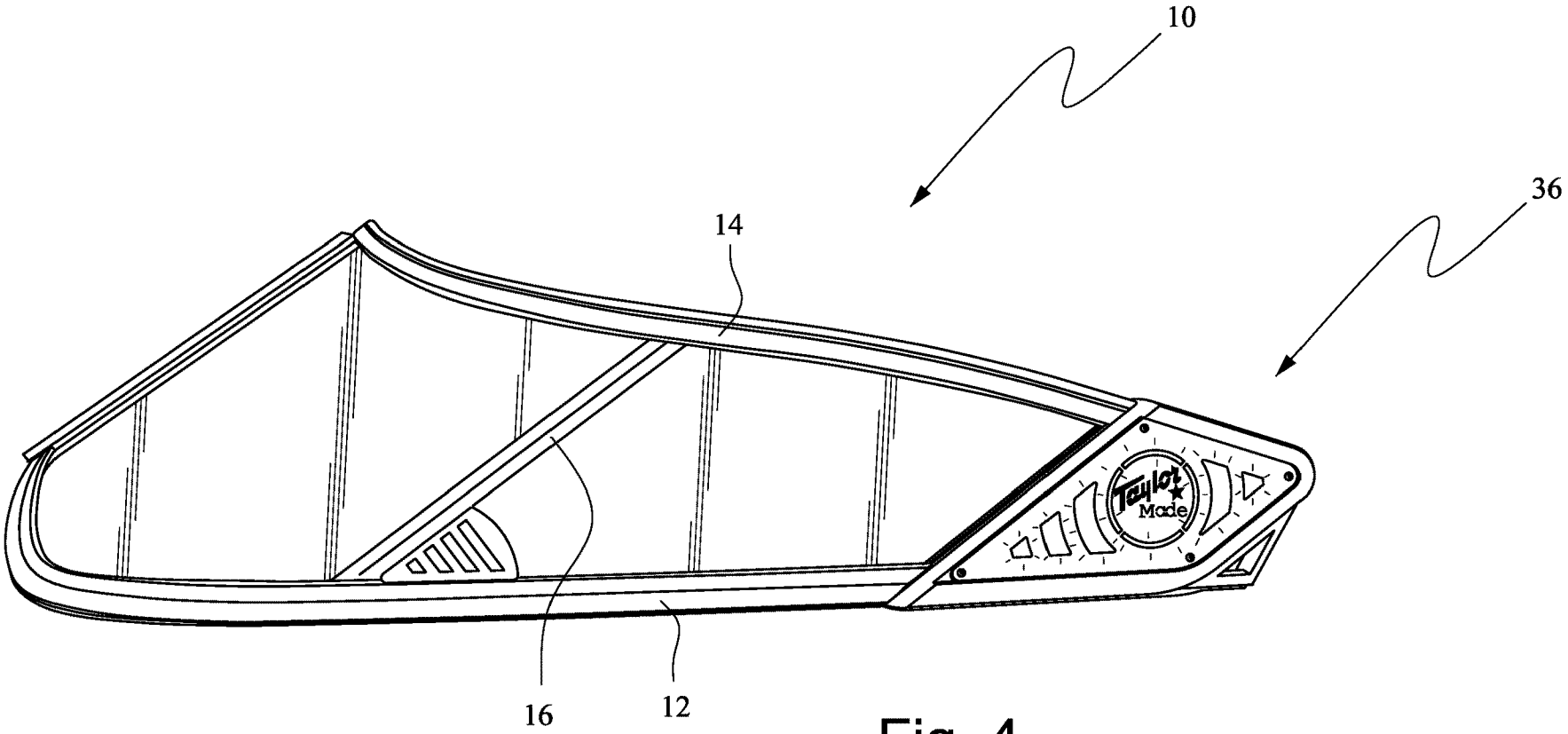
FIG. 4 is an exterior perspective view of the windshield.

FIG. 4 is an exterior perspective view of the windshield assembly 10. A lighting system 36 may be associated with the speaker system. In the exemplary embodiment shown in FIG. 4, the lighting system 36 is associated with the first speaker component 26 in a facing relationship. The lighting system 36 may be coupled with the first speaker component 26 to sandwich the aft end of the side section framework and windshield panel. The lighting system 36 in the illustrated embodiment thus faces away from the passenger area. The lighting system 36 may alternatively be oriented inward or may be oriented both inward and outward. Any known lighting system may be used, for example, a lighting system that is reactive to audio output. That is, the lights in the lighting system 36 may change color or flash or the like according to sounds generated by the speaker system. The lighting systems may have the ability to be solid colors, moving patterns, or other configurations.

By integrating a speaker system into a boat windshield assembly, the speakers can be positioned just above the deck and closer to a passenger head level. The resulting design provides a much more balanced listening experience in a visually pleasing package. The unique aesthetics of the windshield assembly are intended to complement and unify with a boat's design features, colors, and materials. The structures that contain the speakers and/or other audio components can be used as structural members in the windshield's construction if desired (for example, an aft billet assembly or housing integrated with the bottom, vertical, and/or top trims).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A windshield comprising:

a framework including a bottom trim and a top trim;

a windshield panel secured to the framework; and a speaker system secured to the framework adjacent the windshield panel between the bottom trim and the top trim, wherein the framework comprises a forward section and two side sections extending aft from the forward section, the framework defining a passenger area, wherein the speaker system is positioned in the framework adjacent a head level in the passenger area, and wherein the speaker system comprises a first component secured on or through each of the side sections adjacent an aft end of each of the side sections.

2. A windshield according to claim 1, wherein the speaker system comprises a second component secured to each of the side sections adjacent a forward end of each of the side sections.

3. A windshield according to claim 2, wherein the first component comprises a woofer and a tweeter.

4. A windshield according to claim 1, wherein the speaker system is positioned facing the passenger area.

5. A windshield according to claim 4, further comprising a lighting system coupled with the speaker system, the lighting system facing away from the passenger area.

6. A windshield according to claim 5, wherein the lighting system is reactive to audio output.

7. A windshield according to claim 1, wherein at least part of the speaker system is positioned through the windshield panel.

8. A windshield comprising:

a framework including a bottom trim and a top trim;

a windshield panel secured to the framework; and a speaker system secured to the framework adjacent the windshield panel between the bottom trim and the top trim, wherein the framework comprises a forward section and two side sections extending aft from the forward section, the framework defining a passenger area, wherein the speaker system is positioned in the framework adjacent a head level in the passenger area, wherein the framework further comprises a vertical trim connecting each of the two side sections with the forward section, and wherein at least part of the speaker system is bounded by the bottom trim, the windshield panel and the vertical trim.

9. A windshield comprising:

a framework including a bottom trim and a top trim;

a windshield panel secured to the framework; and a speaker system secured to the framework adjacent the windshield panel between the bottom trim and the top trim, wherein the framework comprises a forward section and two side sections extending aft from the forward section, wherein the speaker system comprises a first component secured on each of the side sections and a second component secured on each of the side sections.

10. A windshield according to claim 9, wherein the first component comprises a woofer and a tweeter.

11. A windshield according to claim 9, wherein at least part of the speaker system is positioned through the windshield panel.

12. A windshield according to claim 9, wherein the speaker system is positioned facing the passenger area.

13. A windshield according to claim 12, further comprising a lighting system coupled with the speaker system, the lighting system facing away from the passenger area.

14. A windshield according to claim 13, wherein the lighting system is reactive to audio output.

15. A windshield comprising:

a framework including a bottom trim and a top trim;

a windshield panel secured to the framework; and a speaker system secured to the framework adjacent the windshield panel between the bottom trim and the top trim, wherein the framework comprises a forward section and two side sections extending aft from the forward section, wherein the speaker system comprises a first component secured adjacent an aft end of each of the side sections and a second component secured adjacent a forward end of each of the side sections, wherein the framework further comprises a vertical trim connecting each of the two side sections with the forward section, and wherein at least part of the speaker system is bounded by the bottom trim, the windshield panel and the vertical trim.

* * * * *